US009420656B1

(12) United States Patent
Lu et al.

(10) Patent No.: US 9,420,656 B1
(45) Date of Patent: Aug. 16, 2016

(54) LIGHT EMITTING DIODE DIMMER CIRCUIT

(71) Applicant: Tong Xin Technology Co., Ltd., Taoyuan (TW)

(72) Inventors: Chun-Chieh Lu, Taoyuan (TW); Chun-Liang Lu, Taoyuan (TW)

(73) Assignee: Tong Xin Technology Co., Ltd., Taoyuan (TW)

( * ) Notice: Subject to any disclaimer, the term of this patent is extended or adjusted under 35 U.S.C. 154(b) by 0 days.

(21) Appl. No.: 14/969,661

(22) Filed: Dec. 15, 2015

(51) Int. Cl.
*H05B 33/08* (2006.01)

(52) U.S. Cl.
CPC ..... *H05B 33/0845* (2013.01); *H05B 33/0812* (2013.01)

(58) Field of Classification Search
USPC ..... 315/200 R–297
See application file for complete search history.

(56) References Cited

U.S. PATENT DOCUMENTS

2010/0296324 A1* 11/2010 Boeke ..... H02M 3/1582 363/127
2014/0125241 A1* 5/2014 Elferich ..... H05B 33/0815 315/200 R

* cited by examiner

*Primary Examiner* — Douglas W Owens
*Assistant Examiner* — Jonathan Cooper
(74) *Attorney, Agent, or Firm* — C. G. Mersereau; Nikolai & Mersereau, P.A.

(57) ABSTRACT

A light emitting diode dimmer circuit uses a typically commercially available TRIAC dimmer to modulate an illumination-purpose light emitting diode circuit, and to make up the shortfall of the AC voltage phase, caused by the conductivity phase angle of the TRIAC dimmer, for the energy storage applying the energy storage and rectifier circuit, so that the light output of the light emitting diode can achieve the stable and flicker-free effect in the dimming requirement of the light emitting diode either the micro bright or full bright requirement.

4 Claims, 13 Drawing Sheets

LIGHT EMITTING DIODE DIMMER CIRCUIT

BACKGROUND OF THE INVENTION (1) Field of the Invention

The invention relates to a light emitting diode (LED) dimmer circuit comprising a typically commercially available triode for alternating current (TRIAC) dimmer, a rectifier and filter circuit, an energy storage and rectifier circuit, a buck converter circuit, a light emitting diode circuit and a buck filter circuit (or voltage-drop filter circuit) for modulating the illumination-purpose light emitting diode circuit, and making up the shortfall of the alternating-current (AC) voltage phase, caused by the conductivity phase angle of the TRIAC dimmer, for the energy storage applying the energy storage and rectifier circuit, so that the light output of the light emitting diode can achieve the stable and flicker-free effect in the dimming requirement of the light emitting diode either the micro bright or full bright requirement.

(2) Description of the Prior Art

Currently, the commercially available light emitting diode dimmer circuit can accept the product of the commercially available TRIAC dimmer, and is the fundamental technology using a bleeder current circuit to keep the normal function of the TRIAC, so that the output AC voltage of the TRIAC is acquired, decoded, and converted into a dimming signal to change the switching frequency of the main working crystal, to fix the DC voltage of the light emitting diode circuit, to modulate the current flowing through the light emitting diode circuit, and thus to modulate the light output of the light emitting diode circuit. Thus, the dimming effect of the light emitting diode circuit can be achieved. The adopted TRIAC dimmer drive integrated circuits (TRIAC Dimmer Drive ICs) include LM3445 of Texas Instruments (TI) and Steval-ILL044V1 of STMicroelectronics. The products manufactured by the TRIAC dimmer drive ICs have the following drawbacks.

First, because differences are present between various brands of commercially available TRIAC dimmers, when the commercially available light emitting diode circuit product for the same modulation works in conjunction with different brands or different types of TRIAC dimmers for phase modulation, the decoder for decoding the AC voltage of the TRIAC has an decoding error and thus generates different modulation ranges. Thus, the stable flicker-free dimming effect for the light output of the light emitting diode circuit cannot be achieved.

Second, the bleeder current circuit is composed of active device(s) and passive device(s), wherein both the selection of the active devices and the error of the passive device(s) make the current of the bleeder current circuit fluctuate. Thus, the stable flicker-free dimming effect for the light output of the light emitting diode circuit cannot be achieved.

SUMMARY OF THE INVENTION

The objects of the invention are described in the following.

First, the invention is applicable to various brands of commercially available TRIAC dimmers, wherein only the electric lamp of the existing dimming type electric lamp has to be replaced with the light emitting diode dimmer circuit of the invention without the replacement of the TRIAC dimmer, so that the working time and money can be saved.

Second, the energy storage and rectifier circuit is utilized to execute the stable flicker-free dimming effect for the light output of the light emitting diode circuit.

Third, the buck filter circuit is utilized to filter out the ripple noise and to provide the power for the power supply end of the half bridge buck integrated circuit.

The invention has the following characteristics.

The TRIAC dimmer may be selected from various brands of commercially available TRIAC dimmers with different properties, so that the invention has the broad compatibility, and the characteristic lies in that the typically commercially available TRIAC dimmer can be adopted.

The rectifier and filter circuit is composed of full bridge rectifier(s) and filter capacitor(s) for executing rectifying and filtering functions for the output voltage of the TRIAC dimmer.

Regarding the energy storage and rectifier circuit, the energy storage is composed of inductor(s), and the rectifier circuit is composed of diode(s), wherein the inductor and the diode are connected in series.

The buck converter circuit is a buck switching type converting circuit. Although there are many types of buck converter circuits, the invention is only described according to one embodiment without restricting the technical field of the embodiment of the invention.

The light emitting diode circuit is for modulating the illumination-purpose light emitting diode circuit, and making up the shortfall of the AC voltage phase, caused by the conductivity phase angle of the TRIAC dimmer, for the energy storage applying the energy storage and rectifier circuit, so that the light output of the light emitting diode can achieve the stable and flicker-free effect in the dimming requirement of the light emitting diode (either the micro bright or full bright requirement).

The buck filter circuit drops the DC voltage of the energy storage and rectifier circuit and filters out the ripple noise to provide the DC power for the power supply end of the half bridge buck integrated circuit.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
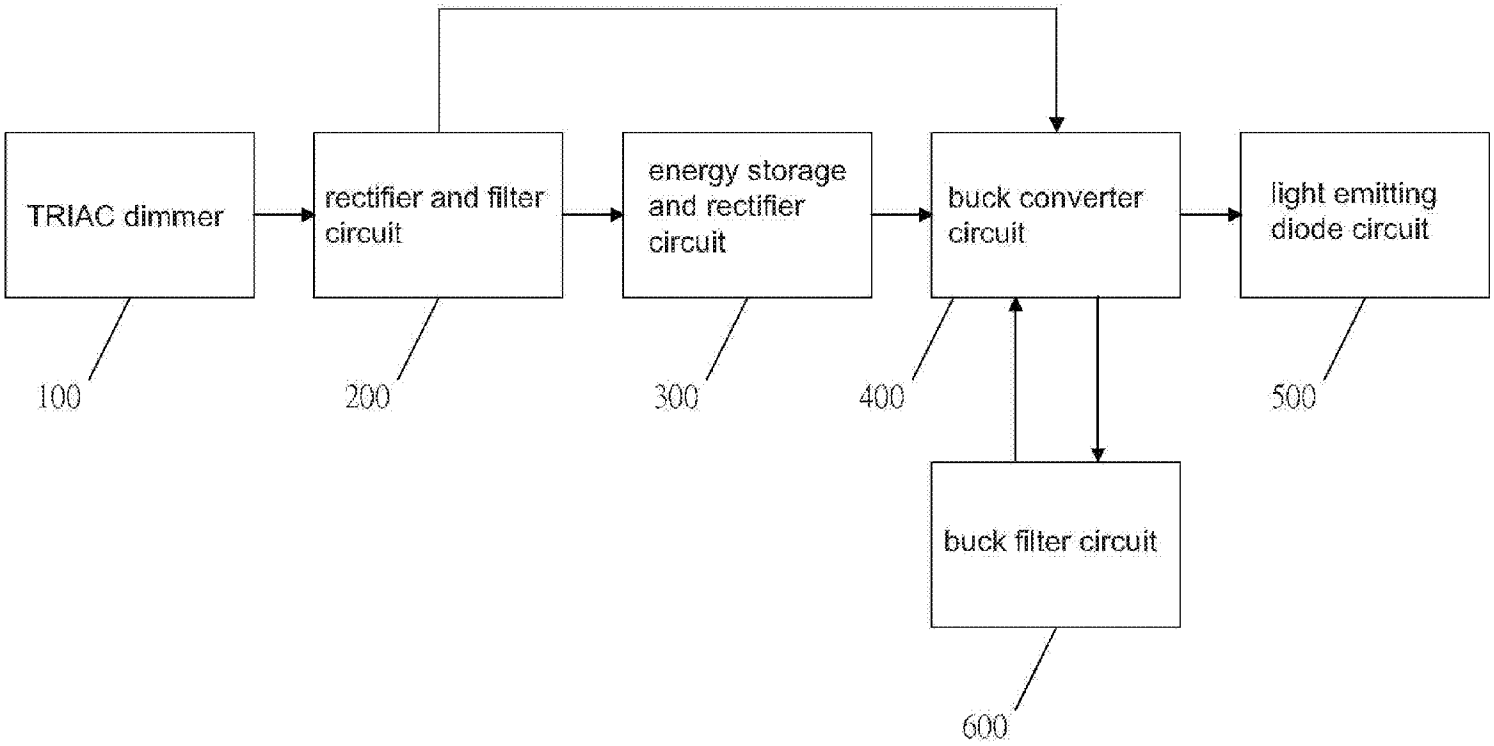
FIG. 1 is a block diagram showing a light emitting diode dimmer circuit of the invention.

FIG. 1 is a block diagram showing a light emitting diode dimmer circuit of the invention. Referring to this drawing, the light emitting diode dimmer circuit comprises a triode for alternating current (TRIAC) dimmer 100, a rectifier and filter circuit 200, an energy storage and rectifier circuit 300, a buck converter circuit 400, a light emitting diode circuit 500 and a buck filter circuit 600. The voltage of the TRIAC dimmer 100 is outputted to the rectifier and filter circuit 200. The voltage of the rectifier and filter circuit 200 is outputted to the buck converter circuit 400 and the energy storage and rectifier circuit 300. The voltage of the energy storage and rectifier circuit 300 is outputted to the buck converter circuit 400. The voltage of the buck converter circuit 400 is outputted to the light emitting diode circuit 500 and the buck filter circuit 600. The voltage of the buck filter circuit 600 is outputted to a power supply end of a half bridge buck integrated circuit IC101 of the buck converter circuit 400.

Figure 2:
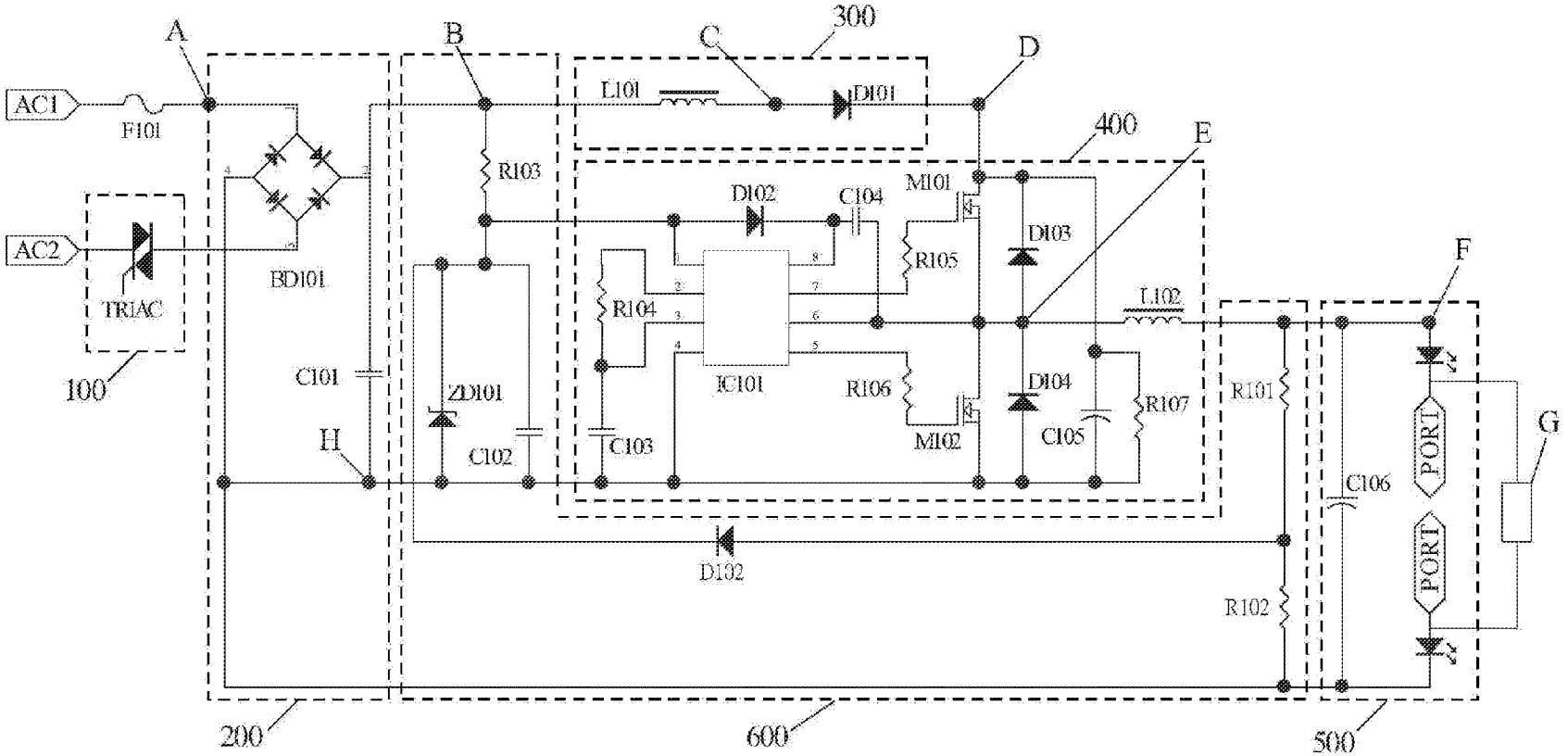
FIG. 2 shows a light emitting diode dimmer circuit according to an embodiment of the invention.

FIG. 2 shows a light emitting diode dimmer circuit according to an embodiment of the invention. As shown in FIG. 2, the TRIAC dimmer 100 is composed of a TRIAC and other passive devices, and may be selected from various brands of commercially available TRIAC dimmers pertaining to the conventional circuit. Thus, the circuit of the passive device will not be listed herein.

The rectifier and filter circuit 200 is composed of a full bridge rectifier BD101 and a first capacitor C101.

The energy storage and rectifier circuit 300 is composed of a first inductor L101 and a first diode D101.

The buck converter circuit 400 is a half bridge buck converter circuit composed of a half bridge buck integrated circuit IC101, a second diode D102, a third diode D103, a fourth diode D104, a fourth resistor R104, a fifth resistor R105, a sixth resistor R106, a seventh resistor R107, a third capacitor C103, a fourth capacitor C104, a fifth capacitor C105, a first metal oxidation semiconductor field effect transistor (MOSFET) M101, a second MOSFET M102 and a second inductor L102. The half bridge buck converter circuit pertains to the conventional circuit, so the operation principle thereof will be omitted.

The light emitting diode circuit 500 is composed of a sixth capacitor C106 and an LED group.

The buck filter circuit 600 is composed of a third resistor R103, an eighth resistor R108, a ninth resistor R109, a fifth diode D105, a second capacitor C102 and a first regulator diode ZD101 (Zener Diode).

FIG. 2 shows the embodiment of the light emitting diode dimmer circuit of the invention. In FIG. 2, measuring points A, B, C, D, E, F, G and H are present, wherein the point H is the common ground point. The measuring points A, B, C, D, E, F and G correspond to FIGS. 3A to 3G, which show full power output waveform diagrams of the light emitting diode dimmer circuit of the invention, FIGS. 4A to 4G, which show half power output waveform diagrams of the light emitting diode dimmer circuit of the invention, and FIGS. 5A to 5G, which show micro power output waveform diagrams of the light emitting diode dimmer circuit of the invention. The operation principle of FIG. 2 will be described in the following with reference to the waveform diagrams of FIGS. 3A to 3G, 4A to 4G and 5A to 5G.

Figure 3A:
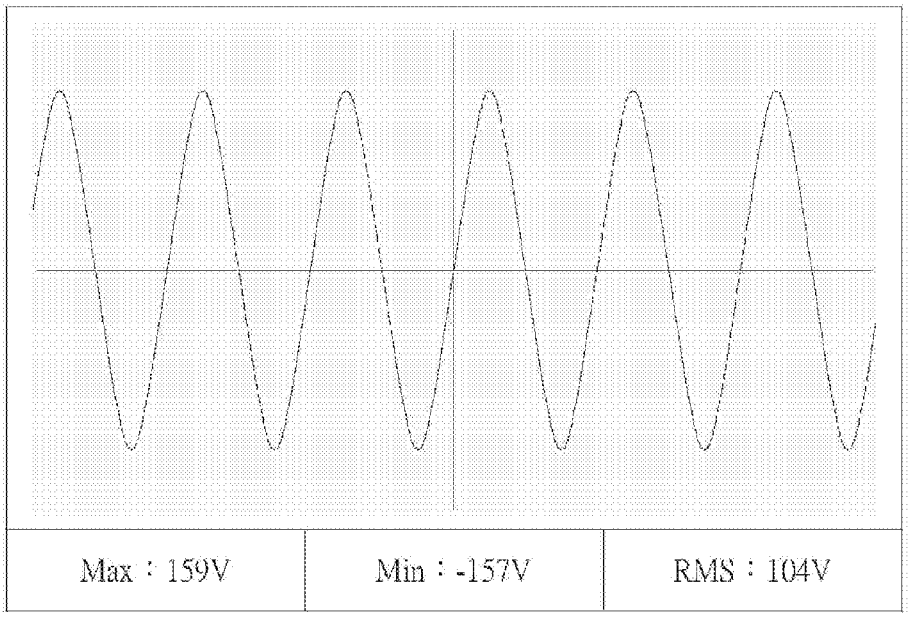
FIGS. 3A to 3G show full power output waveform diagrams of the light emitting diode dimmer circuit of the invention.
Figure 3B:
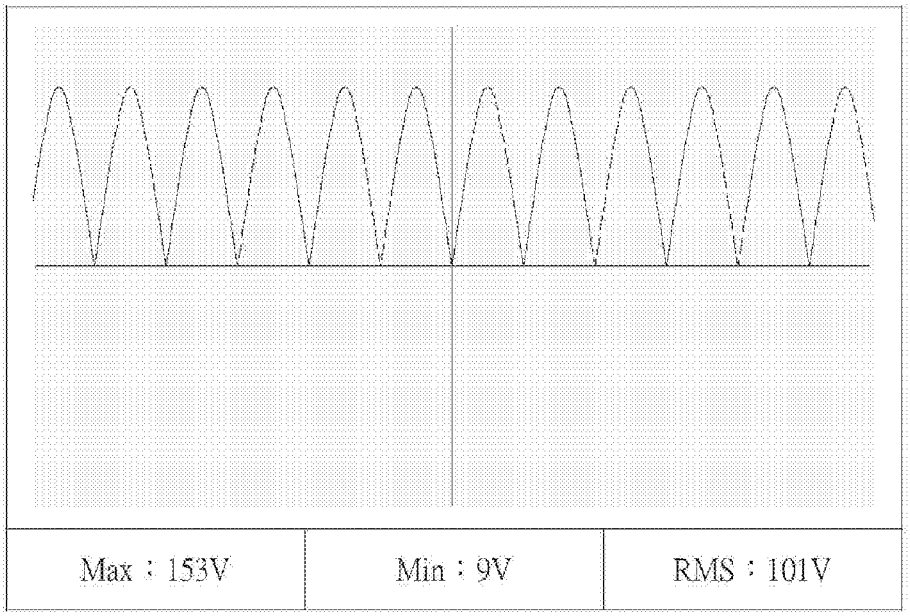
Figure 3C:
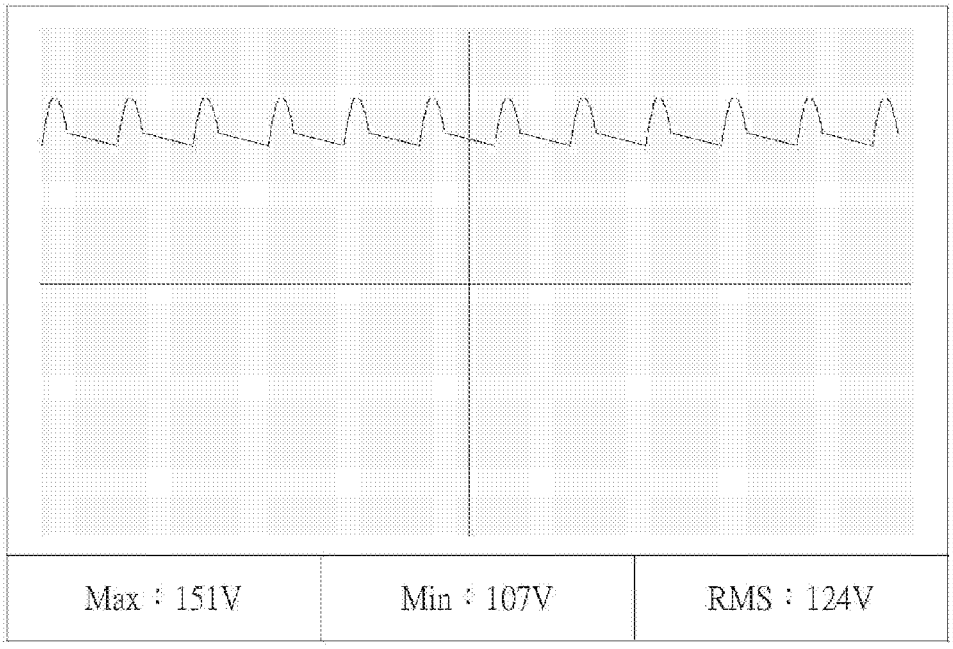
Figure 3D:
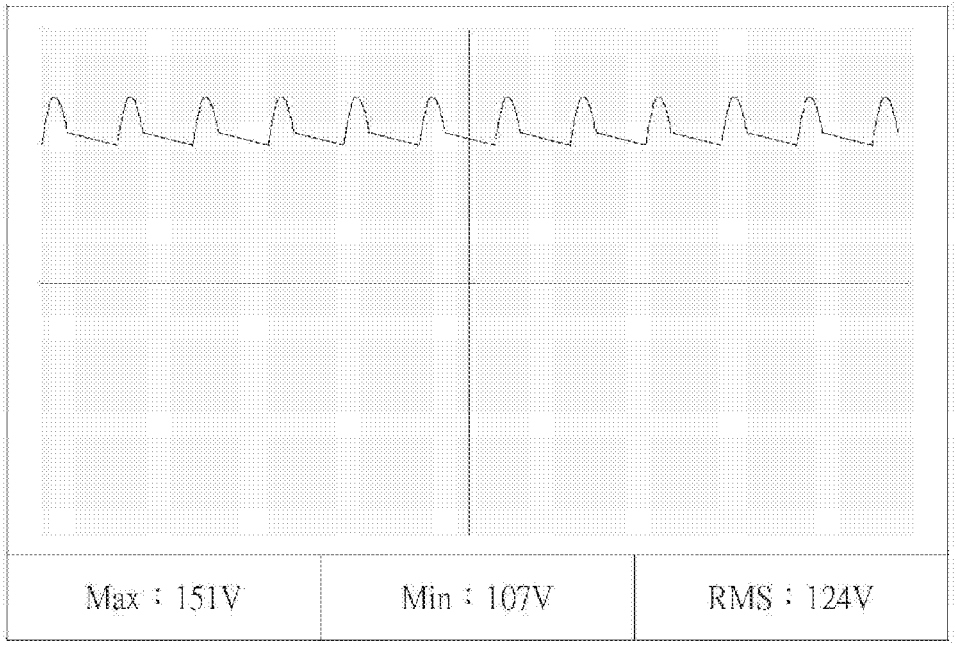
Figure 3E:
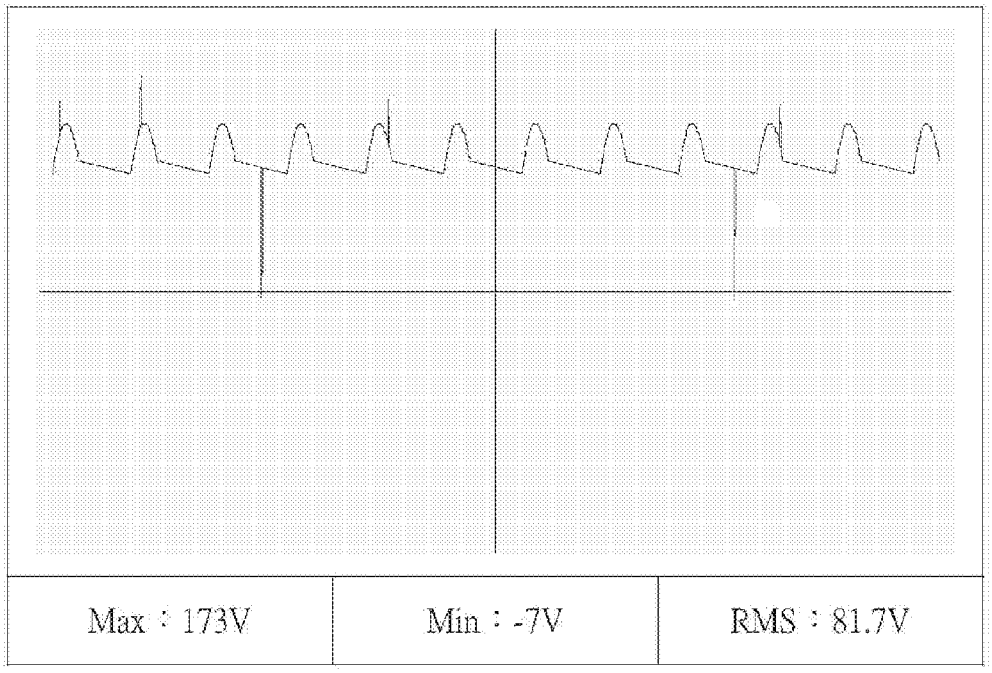
Figure 3F:
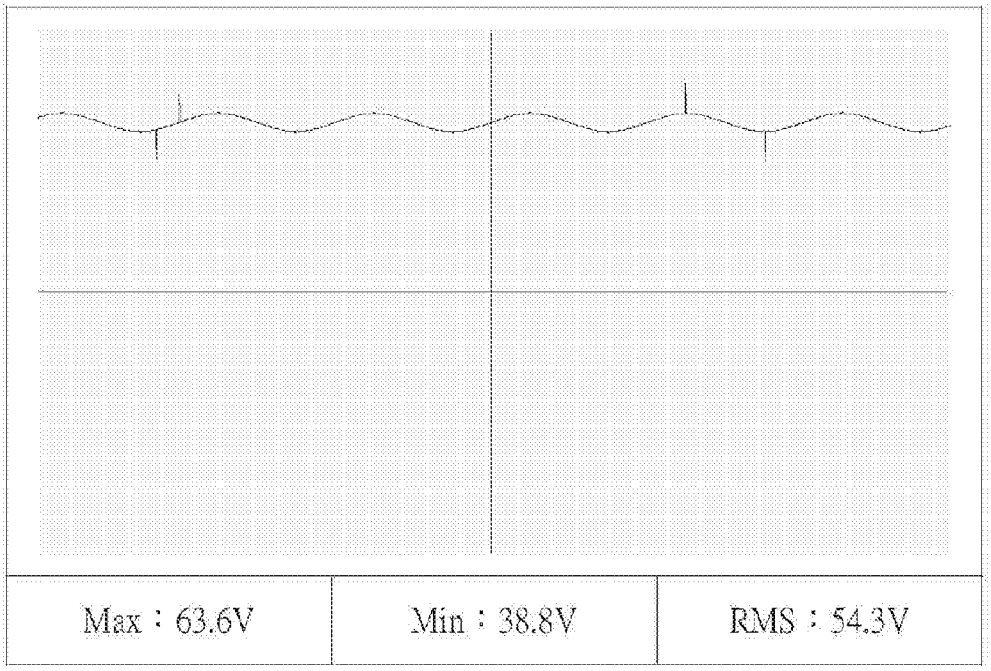
Figure 3G:
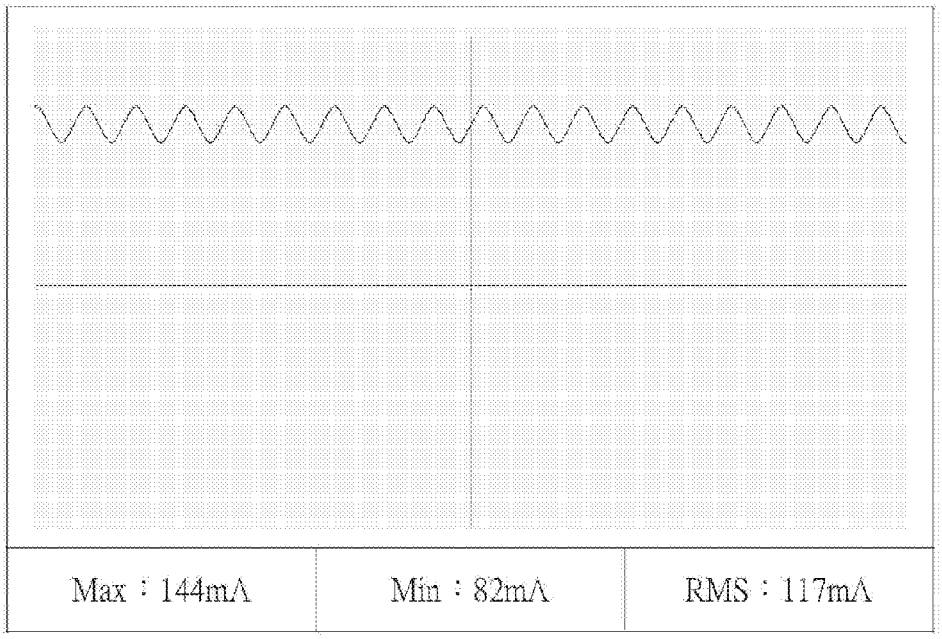

When the light emitting diode dimmer circuit of the invention has the full power output, the AC power is inputted into the power input terminals (AC input terminals AC1 and AC2) of the circuit of the invention of FIG. 2, and the output of the TRIAC dimmer 100 is set to maximum, wherein the output waveform thereof is the waveform of the FIG. 3A corresponding to the input voltage of the full bridge rectifier BD101 at the point A of FIG. 2. As shown in this drawing, it is obtained that when the TRIAC's trigger angle is the maximum, the output voltage is also the maximum, wherein the maximum output voltage is Max=159V, the minimum voltage is Min=−157V, and the effective voltage is RMS=104V. The waveform of the output voltage after being rectified by the full bridge rectifier BD101 of the rectifier and filter circuit 200 and filtered by the first capacitor C101 is shown in FIG. 3B corresponding to the output voltage at the point B of FIG. 2, wherein the maximum output voltage is Max=153V, the minimum voltage is Min=9V, and the effective voltage is RMS=101V. After passing through the first inductor L101 of the energy storage of the energy storage and rectifier circuit 300, the waveform of the output voltage is shown in FIG. 3C corresponding to the waveform at the point C of FIG. 2, wherein the maximum output voltage is Max=151V, the minimum voltage is Min=107V, and the effective voltage is RMS=124V. After passing through the rectifying first diode D101, the waveform of the output voltage is shown in FIG. 3D corresponding to the waveform at the point D of FIG. 2, wherein the maximum output voltage is Max=151V, the minimum voltage is Min=107V, and the effective voltage is RMS=124V. After passing through the high-voltage side power supply end of the buck converter circuit 400 (i.e., the point D of FIG. 2), the waveform of the input voltage of the second inductor L102 is shown in FIG. 3E corresponding to the waveform at the point E of FIG. 2, wherein the maximum output voltage is Max=173V, the minimum voltage is Min=−7V, and the effective voltage is RMS=81.7V. After passing through the light emitting diode circuit 500 and filtered by the sixth capacitor C106, the waveform of the output voltage is shown in FIG. 3F corresponding to the waveform of the point F of FIG. 2, wherein the maximum output voltage is Max=63.6V, the minimum voltage is Min=38.8V, and the effective voltage is RMS=54.3V. The waveform of the current flowing through the light emitting diode is shown in FIG. 3G corresponding to the waveform at the point G of FIG. 2, wherein the maximum output current is Max=144 mA, the minimum current is Min=82 mA, and the effective current is RMS=117 mA. The output voltage of the second inductor L102 is supplied to the buck filter circuit 600, and is divided, by the voltage dividing resistors of the first resistor R101 and the second resistor R102, into a divided voltage, wherein the divided voltage is filtered by the second diode D102 to the first regulator diode DZ101 and the second capacitor C102, and then supplied to the power supply end of the half bridge buck integrated circuit IC101. The point H of FIG. 2 is the common ground point, and the voltage waveforms of FIGS. 3A to 3G are shown with respect to the common ground point (point H), wherein the maximum output voltage, the minimum voltage and the effective voltage of the measured voltage waveform as well as the maximum output current, the minimum current and the effective current of the measured current waveform represent the actual resultant data using data, and it is also proved that the invention can be implemented. The measuring instrument used in the invention is an oscilloscope of Pektronix Company with the model of DPO4034. All the data of the measuring points of the circuit of the invention fall within the error tolerance range of the instrument.

Figure 4A:
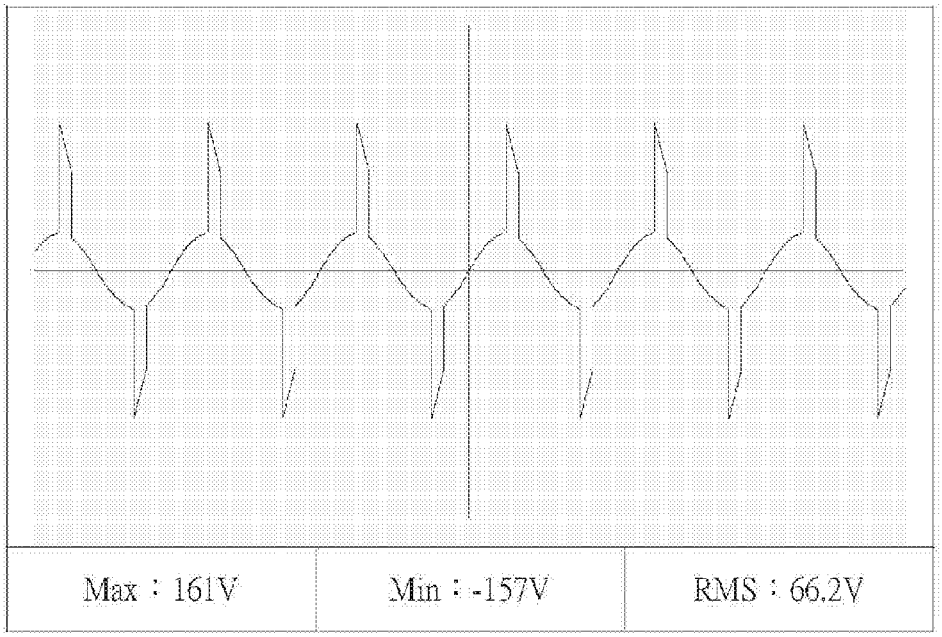
FIGS. 4A to 4G show half power output waveform diagrams of the light emitting diode dimmer circuit of the invention.
Figure 4B:
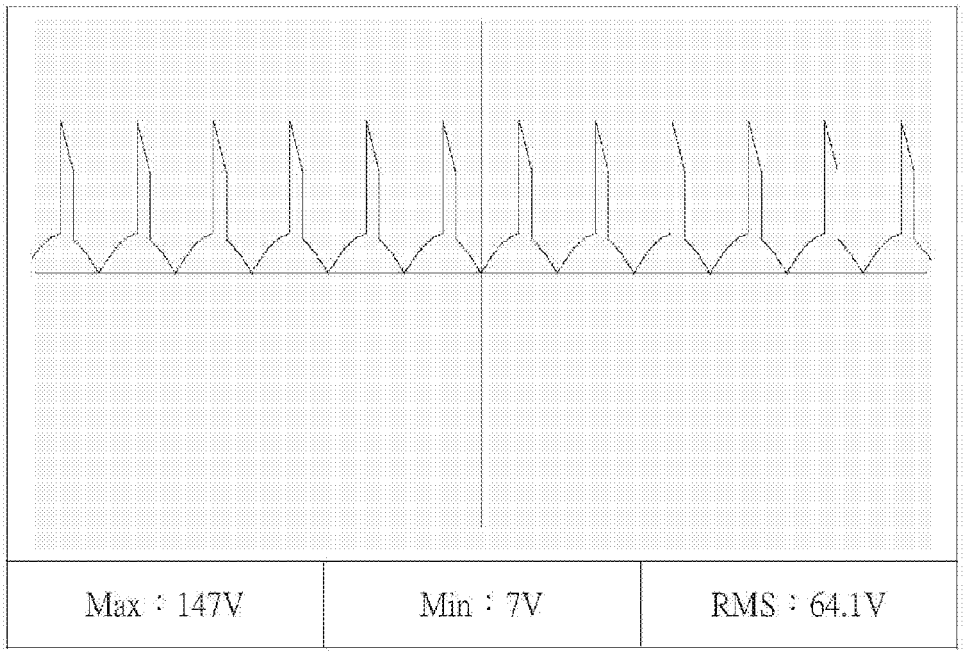
Figure 4C:
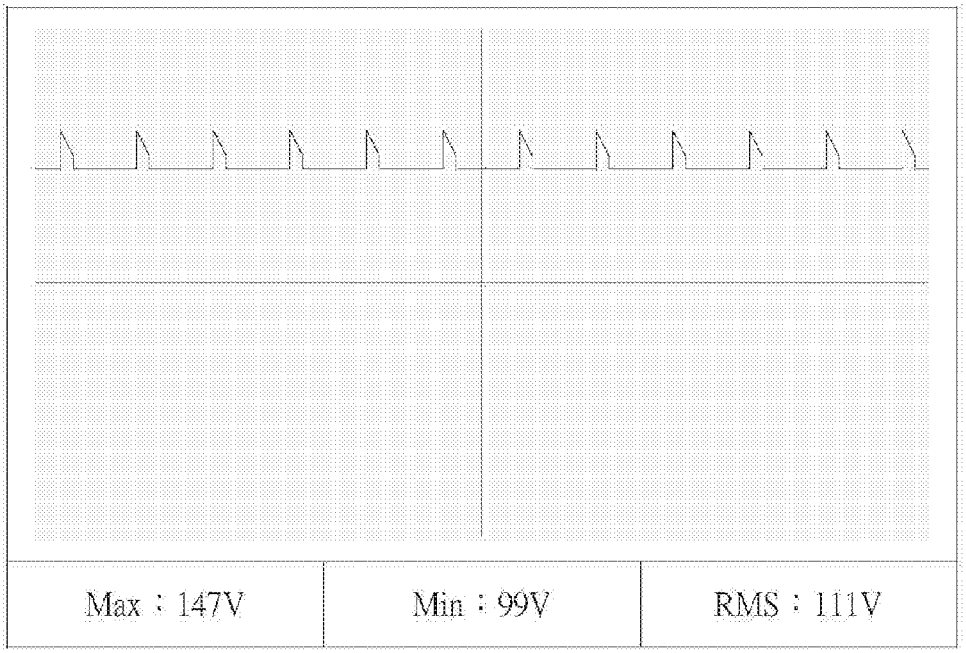
Figure 4D:
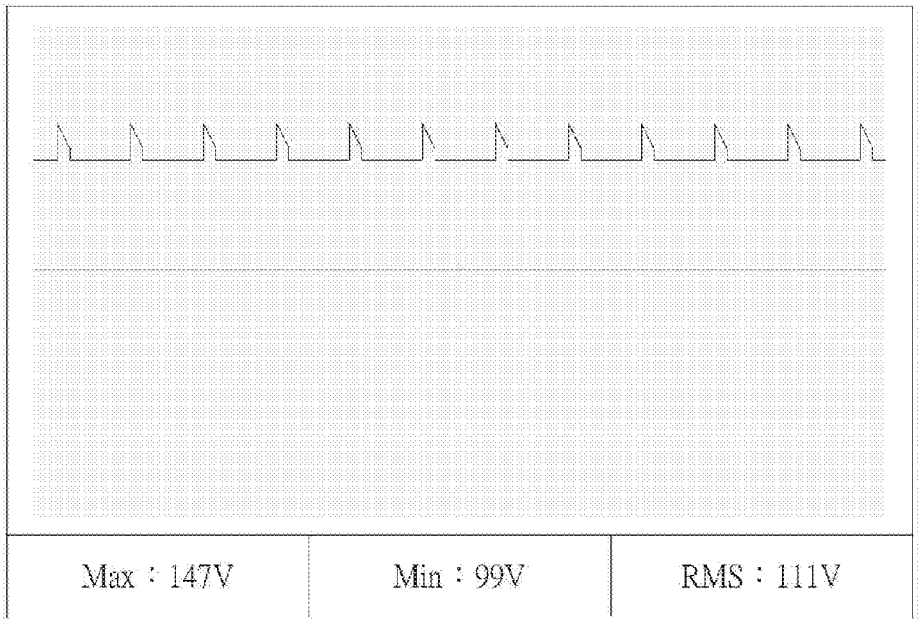
Figure 4E:
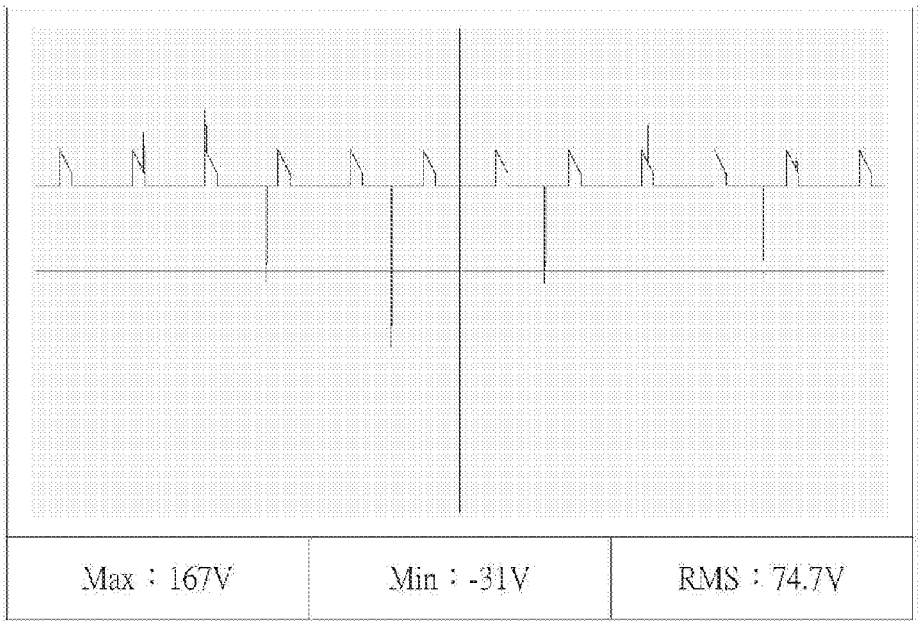
Figure 4F:
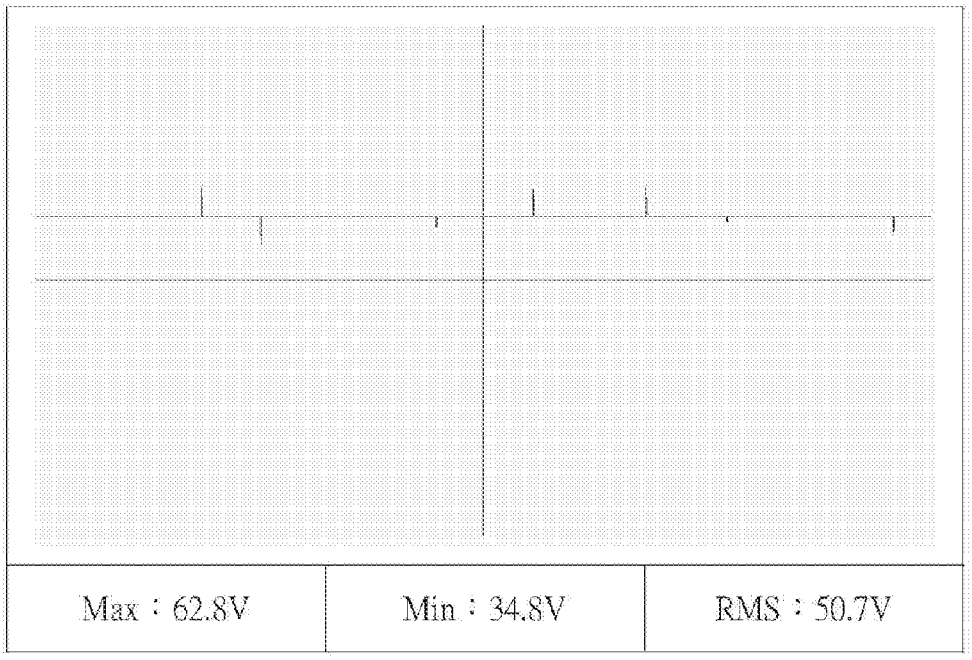
Figure 4G:
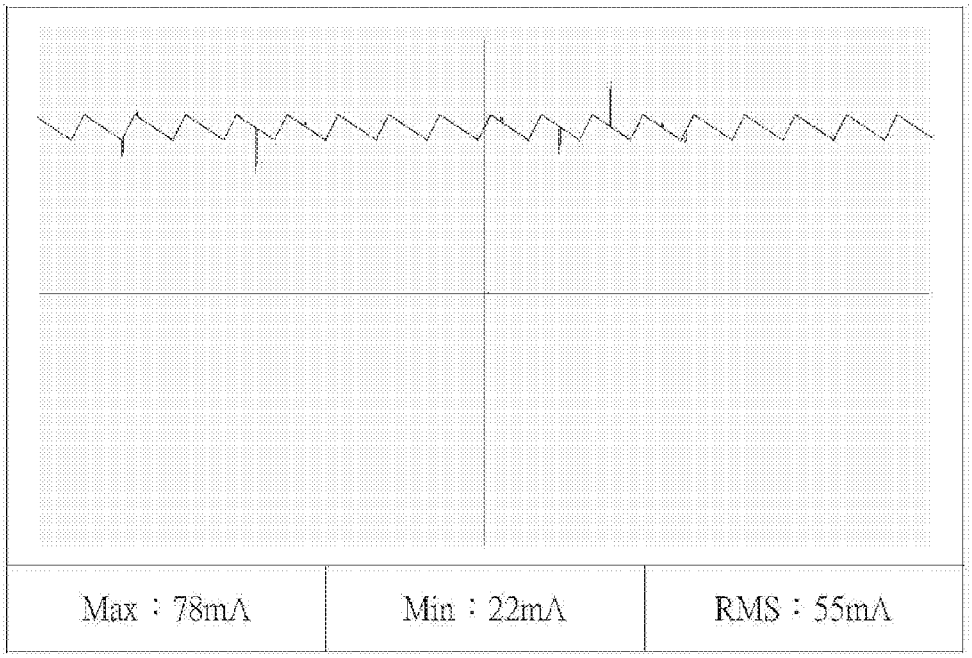

When the light emitting diode dimmer circuit of the invention has the half power output, the AC power is inputted into the power input terminals of the circuit of the invention of FIG. 2, and the output of the TRIAC dimmer 100 is adjusted to one half of the maximum output value, wherein the output waveform thereof is the waveform of FIG. 4A corresponding to the input voltage of the full bridge rectifier BD101 at the point A of FIG. 2. As shown in this drawing, it is obtained that the trigger angle of the TRIAC is about one half of the maximum trigger angle, wherein the maximum output voltage is Max=161V, the minimum voltage is Min=−157V, and the effective voltage is RMS=66.2V. The waveform of the output voltage after being rectified by the full bridge rectifier BD101 of the rectifier and filter circuit 200 and filtered by the first capacitor C101 is shown in FIG. 4B corresponding to the output voltage at the point B of FIG. 2, wherein the maximum output voltage is Max=147V, the minimum voltage is Min=7V, and the effective voltage is RMS=64.1V. After passing through the first inductor L101 of the energy storage of the energy storage and rectifier circuit 300, the waveform of the output voltage is shown in FIG. 4C corresponding to the waveform at the point C of FIG. 2, wherein the maximum output voltage is Max=147V, the minimum voltage is Min=99V, and the effective voltage is RMS=111V. After passing through the rectifying first diode D101, the waveform of the output voltage is shown in FIG. 4D corresponding to the waveform at the point D of FIG. 2, wherein the maximum output voltage is Max=147V, the minimum voltage is Min=99V, and the effective voltage is RMS=111V. After passing through the high-voltage side power supply end of the buck converter circuit 400 (i.e., the point D of FIG. 2), the waveform of the input voltage of the second inductor L102 is shown in FIG. 4E corresponding to the waveform at the point E of FIG. 2, wherein the maximum output voltage is Max=167V, the minimum voltage is Min=−31V, and the effective voltage is RMS=74.7V. After passing through the light emitting diode circuit 500 and filtered by the sixth capacitor C106, the waveform of the output voltage is shown in FIG. 4F corresponding to the waveform of the point F of FIG. 2, wherein the maximum output voltage is Max=62.8V, the minimum voltage is Min=34.8V, and the effective voltage is RMS=50.7V. The waveform of the current flowing through the light emitting diode is shown in FIG. 4G corresponding to the waveform at the point G of FIG. 2, wherein the maximum output current is Max=78 mA, the minimum current is Min=22 mA, and the effective current is RMS=55 mA. The output voltage of the second inductor L102 is supplied to the buck filter circuit 600, and is divided, by the voltage dividing resistors of the first resistor R101 and the second resistor R102, into a divided voltage, wherein the divided voltage is filtered by the fifth diode D105 to the first regulator diode DZ101 and the second capacitor C102, and then supplied to the power supply end of the half bridge buck integrated circuit IC101. The point H of FIG. 2 is the common ground point, and the voltage waveforms of FIGS. 4A to 4G are shown with respect to the common ground point (point H), wherein the maximum output voltage, the minimum voltage and the effective voltage of the measured voltage waveform as well as the maximum output current, the minimum current and the effective current of the measured current waveform represent the actual resultant data using data, and it is also proved that the invention can be implemented. The measuring instrument used in the invention is an oscilloscope of Pektronix Company with the model of DPO4034. All the data of the measuring points of the circuit of the invention fall within the error tolerance range of the instrument.

Figure 5A:
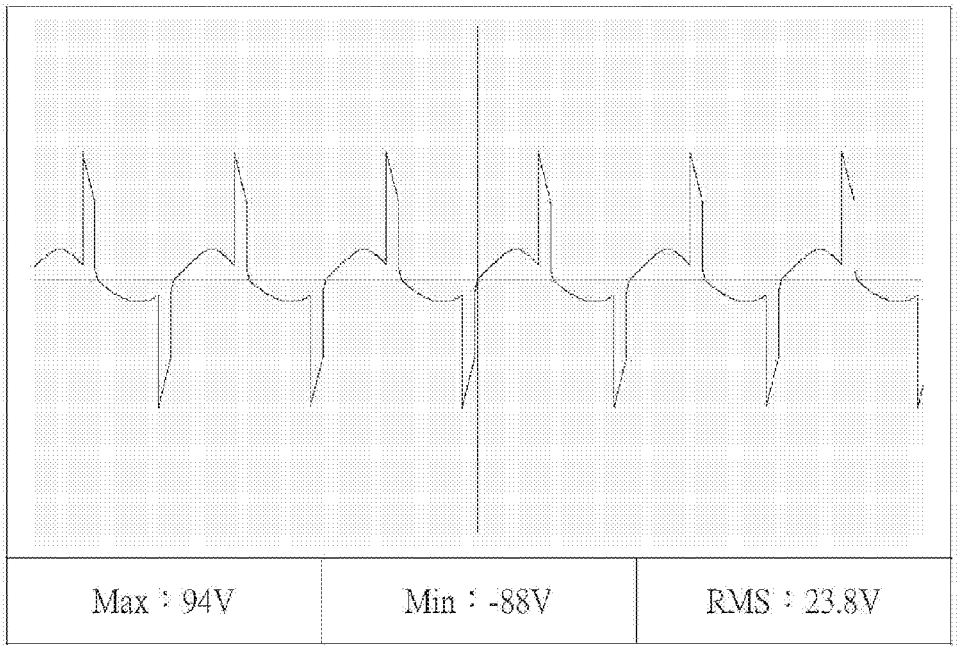
FIGS. 5A to 5G show micro power output waveform diagrams of the light emitting diode dimmer circuit of the invention.
Figure 5B:
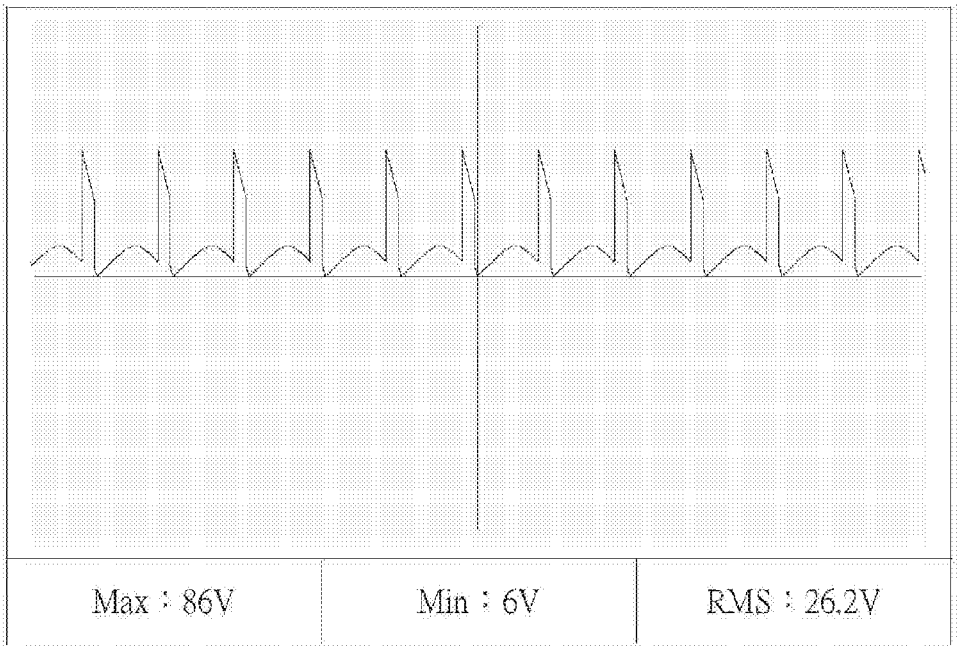
Figure 5C:
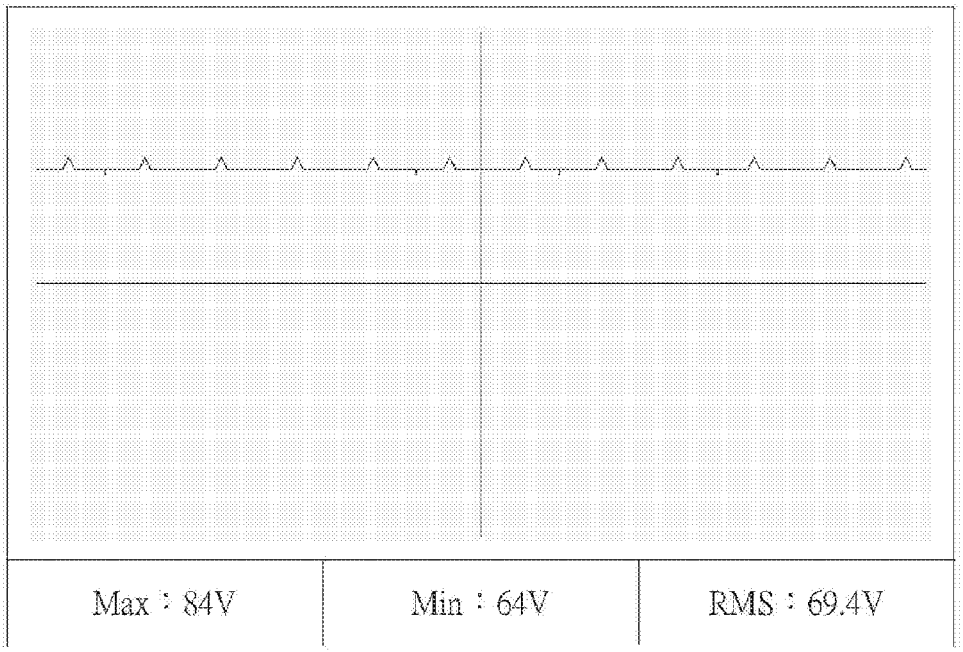
Figure 5D:
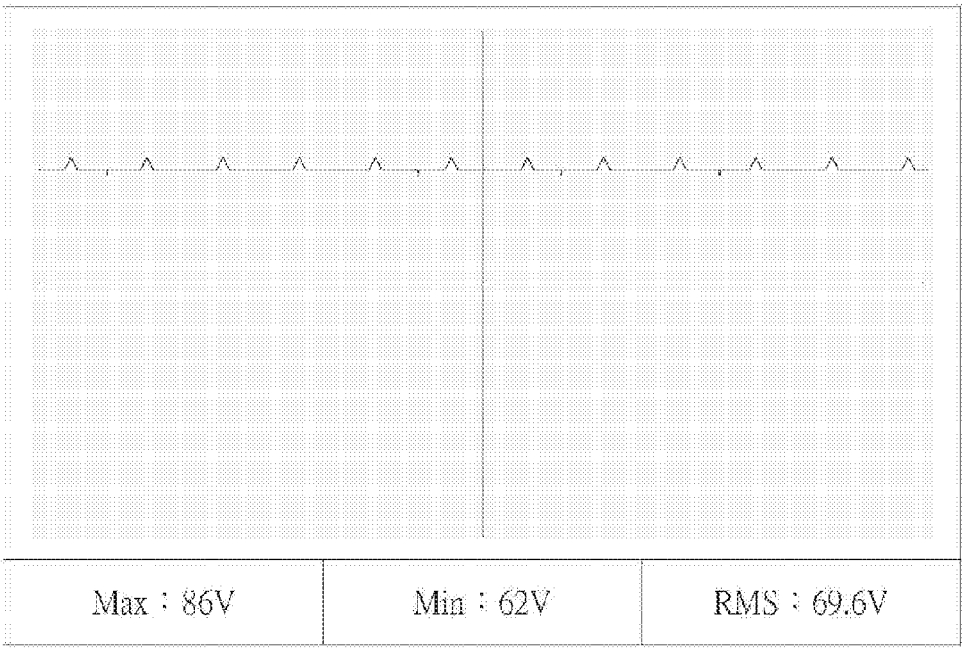
Figure 5E:
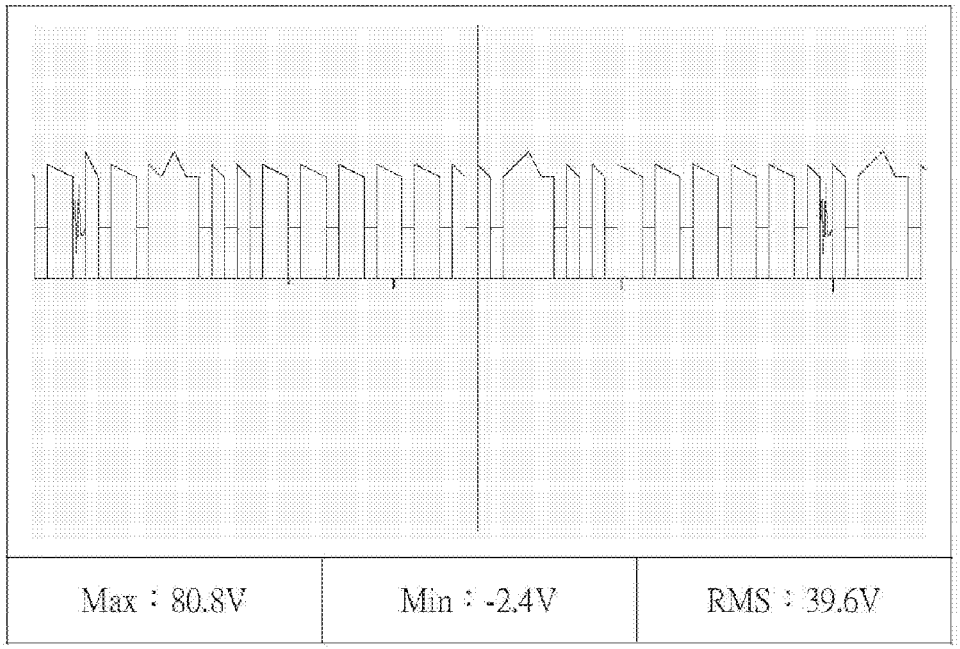
Figure 5F:
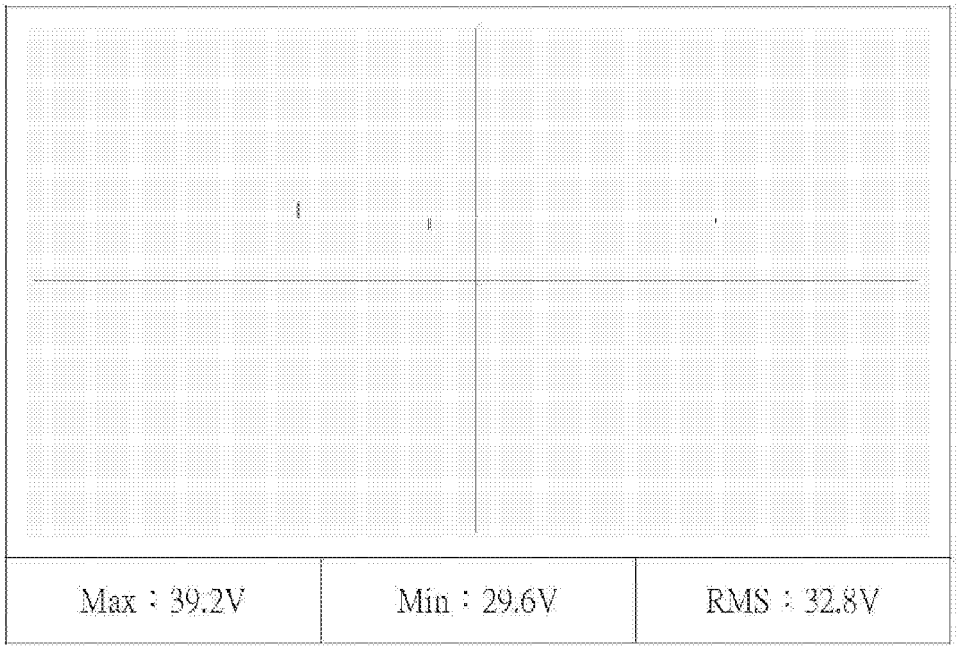
Figure 5G:
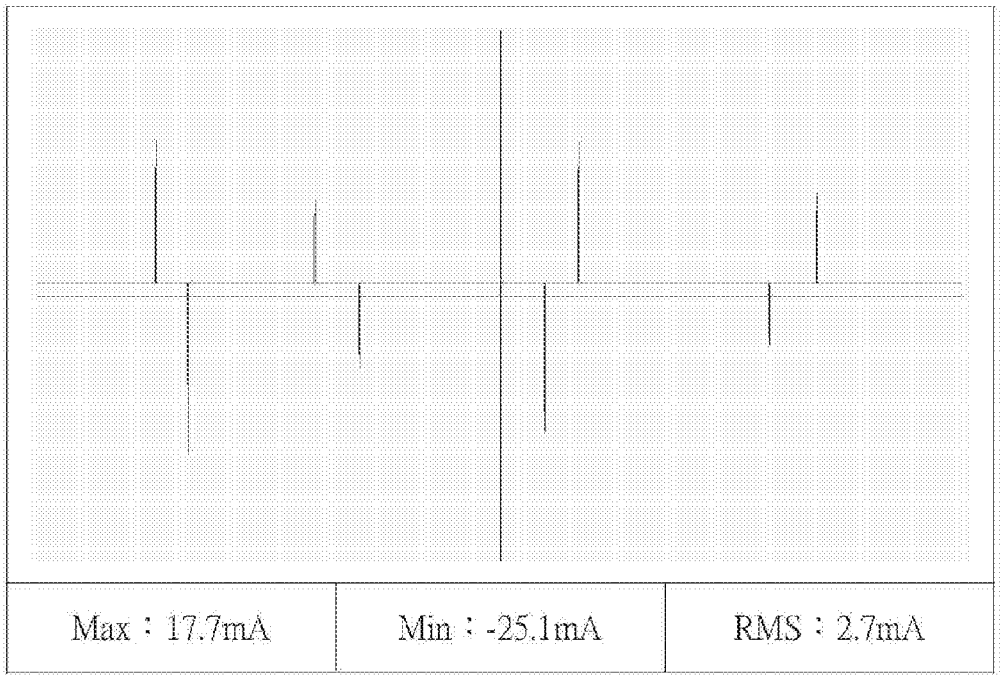

When the light emitting diode dimmer circuit of the invention has the micro power output, the AC power is inputted into the power input terminals of the circuit of the invention of FIG. 2, and the output of the TRIAC dimmer 100 is adjusted to the smallest output value, wherein the output waveform thereof is the waveform of FIG. 5A corresponding to the input voltage of the full bridge rectifier BD101 at the point A of FIG. 2. As shown in this drawing, it is obtained that the trigger angle of the TRIAC is the small trigger angle, wherein the maximum output voltage is Max=94V, the minimum voltage is Min=−88V, and the effective voltage is RMS=23.8V. The waveform of the output voltage after being rectified by the full bridge rectifier BD101 of the rectifier and filter circuit 200 and filtered by the first capacitor C101 is shown in FIG. 5B corresponding to the output voltage at the point B of FIG. 2, wherein the maximum output voltage is Max=86V, the minimum voltage is Min=6V, and the effective voltage is RMS=26.2V. After passing through the first inductor L101 of the energy storage of the energy storage and rectifier circuit 300, the waveform of the output voltage is shown in FIG. 5C corresponding to the waveform at the point C of FIG. 2, wherein the maximum output voltage is Max=84V, the minimum voltage is Min=64V, and the effective voltage is RMS=69.4V. After passing through the rectifying first diode D101, the waveform of the output voltage is shown in FIG. 5D corresponding to the waveform at the point D of FIG. 2, wherein the maximum output voltage is Max=86V, the minimum voltage is Min=62V, and the effective voltage is RMS=69.6V. After passing through the high-voltage side power supply end of the buck converter circuit 400 (i.e., the point D of FIG. 2), the waveform of the input voltage of the second inductor L102 is shown in FIG. 5E corresponding to the waveform at the point E of FIG. 2, wherein the maximum output voltage is Max=80.8V, the minimum voltage is Min=−2.4V, and the effective voltage is RMS=39.6V. After passing through the light emitting diode circuit 500 and filtered by the sixth capacitor C106, the waveform of the output voltage is shown in FIG. 5F corresponding to the waveform of the point F of FIG. 2, wherein the maximum output voltage is Max=39.2V, the minimum voltage is Min=29.6V, and the effective voltage is RMS=32.8V. The waveform of the current flowing through the light emitting diode is shown in FIG. 5G corresponding to the waveform at the point G of FIG. 2, wherein the maximum output current is Max=17.7 mA, the minimum current is Min=−25.1 mA, and the effective current is RMS=2.7 mA. The output voltage of the second inductor L102 is supplied to the buck filter circuit 600, and is divided, by the voltage dividing resistors of the first resistor R101 and the second resistor R102, into a divided voltage, wherein the divided voltage is filtered by the second diode D102 to the first regulator diode DZ101 and the second capacitor C102, and then supplied to the power supply end of the half bridge buck integrated circuit IC101. The point H of FIG. 2 is the common ground point, and the voltage waveforms of FIGS. 5A to 5G are shown with respect to the common ground point (point H), wherein the maximum output voltage, the minimum voltage and the effective voltage of the measured voltage waveform as well as the maximum output current, the minimum current and the effective current of the measured current waveform represent the actual resultant data using data, and it is also proved that the invention can be implemented. The measuring instrument used in the invention is an oscilloscope of Pektronix Company with the model of DPO4034. All the data of the measuring points of the circuit of the invention fall within the error tolerance range of the instrument.

To sum up, in the waveform diagram of the full power output of the light emitting diode dimmer circuit of the invention, the light emitting diode has the effective voltage of 63.6V and the effective current of 144 mA; in the waveform diagram of the half power output of the light emitting diode dimmer circuit of the invention, the light emitting diode has the effective voltage of 62.8V and the effective current of 55 mA; and in the waveform diagram of the micro power output of the light emitting diode dimmer circuit of the invention, the light emitting diode has the effective voltage of 39.2V and the effective current of 2.7 mA. It can be obtained that when the TRIAC dimmer 100 of the invention is adjusted to the smallest power output, the effective current of the light emitting diode may also reach 2.7 mA, so that the light emitting diode does not extinguish and obtains the stable current.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A light emitting diode dimmer circuit, comprising:

a triode for alternating current (TRIAC) dimmer comprising a TRIAC;

a rectifier and filter circuit, which comprises a full bridge rectifier and a first filter capacitor, and is electrically connected to a voltage output end of the TRIAC dimmer;

an energy storage and rectifier circuit, which comprises a first inductor and a first diode, and is electrically connected to an output terminal of the rectifier and filter circuit;

a buck converter circuit, which comprises a half bridge buck integrated circuit, and has a high-voltage side power supply source electrically connected to an output terminal of the energy storage and rectifier circuit;

a light emitting diode circuit, which comprises a light emitting diode group, and has an input terminal electrically connected to an output terminal of a second inductor of the half bridge buck integrated circuit of the buck converter circuit; and a buck filter circuit comprising an first resistor, a second resistor, a second diode, a first regulator diode and a second capacitor, wherein an input terminal of the buck filter circuit is electrically connected to the output terminal of the second inductor of the buck converter circuit, an output terminal of the buck filter circuit is electrically connected to a power supply end of the half bridge buck integrated circuit of the buck converter circuit.

2. The light emitting diode dimmer circuit according to claim 1, wherein the rectifier and filter circuit rectifies and filters a voltage outputted from the TRIAC dimmer circuit.

3. The light emitting diode dimmer circuit according to claim 1, wherein the energy storage and rectifier circuit further comprises a first inductor connected to the first diode in series.

4. The light emitting diode dimmer circuit according to claim 1, wherein the buck filter circuit drops a DC voltage of the output terminal of the second inductor of the half bridge buck integrated circuit and filters out ripple noise, and the buck filter circuit outputs a DC power to the power supply end of the half bridge buck integrated circuit.

* * * * *